US009737120B2

(12) United States Patent
Gordin

(10) Patent No.: US 9,737,120 B2
(45) Date of Patent: Aug. 22, 2017

(54) MOBILITY DEVICE

(71) Applicant: Vadim Gordin, Louisville, KY (US)

(72) Inventor: Vadim Gordin, Louisville, KY (US)

( * ) Notice: Subject to any disclaimer, the term of this patent is extended or adjusted under 35 U.S.C. 154(b) by 0 days.

(21) Appl. No.: 14/988,733

(22) Filed: Jan. 5, 2016

(65) Prior Publication Data

US 2016/0354275 A1 Dec. 8, 2016

Related U.S. Application Data

(60) Provisional application No. 62/110,504, filed on Jan. 31, 2015, provisional application No. 62/100,035, filed on Jan. 5, 2015, provisional application No. 62/156,993, filed on May 5, 2015, provisional application No. 62/104,790, filed on Jan. 18, 2015.

(51) Int. Cl.

| | |
|---|---|
| ***A45B 1/04*** | (2006.01) |
| ***A61H 3/00*** | (2006.01) |
| *A45B 9/02* | (2006.01) |
| *A61H 3/02* | (2006.01) |

(52) U.S. Cl.

CPC ..... *A45B 1/04* (2013.01); *A61H 3/00* (2013.01); *A45B 9/02* (2013.01); *A61H 2003/0255* (2013.01); *A61H 2201/0119* (2013.01)

(58) Field of Classification Search

CPC .... A45B 3/00; A45B 1/04; A45B 9/02; A61H 2003/0255

USPC ..... 135/72, 76; 296/1.02; 280/304.1

See application file for complete search history.

(56) References Cited

U.S. PATENT DOCUMENTS

| | | | | |
|---|---|---|---|---|
| 4,626,016 | A | 12/1986 | Bergsten | |
| 5,005,599 | A | 4/1991 | Cunningham | |
| 5,445,174 | A | 8/1995 | Cunningham | |
| 5,913,562 | A | 6/1999 | Mattarella | |
| 6,340,189 | B1 | 1/2002 | Pordy | |
| 6,574,833 | B1 * | 6/2003 | Tomaiuolo | B60N 3/026 16/110.1 |
| 6,799,353 | B1 * | 10/2004 | Stewart | B60N 3/023 16/110.1 |
| 6,990,990 | B2 | 1/2006 | Wilensky | |
| 8,308,406 | B2 * | 11/2012 | Parks | A61G 5/10 410/4 |
| 8,650,735 | B2 * | 2/2014 | Johnson | A61G 3/0808 280/304.1 |
| 8,714,171 | B1 | 5/2014 | Haygood | |
| 8,870,209 | B2 * | 10/2014 | Conrad | B60D 1/167 280/250.1 |
| 9,296,323 | B2 * | 3/2016 | Voisin | B60N 3/02 |
| 9,403,466 | B1 * | 8/2016 | Deng | B60N 3/023 |
| 2005/0133078 | A1 * | 6/2005 | Fujitsubo | B60N 3/026 135/72 |
| 2009/0145470 | A1 | 6/2009 | Couper | |
| 2009/0214314 | A1 * | 8/2009 | Girardin | B60P 3/073 410/7 |

* cited by examiner

*Primary Examiner* — Noah Chandler Hawk

(57) ABSTRACT

According to certain embodiments of the present disclosure, a mobility device includes, an elongated body having a first end and a second end; a joint near the first end of the body configured to attach the body to at least one of; a walker, a wheelchair, or a rollator; and a coupler near the second end of the body configured to removably attach the body to the striker plate of an automobile doorframe.

8 Claims, 18 Drawing Sheets

1000

Figure 17a
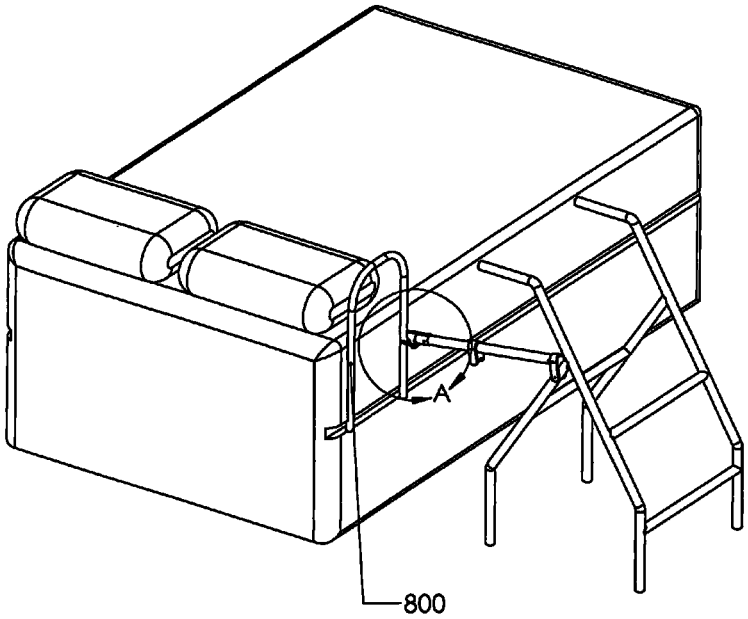
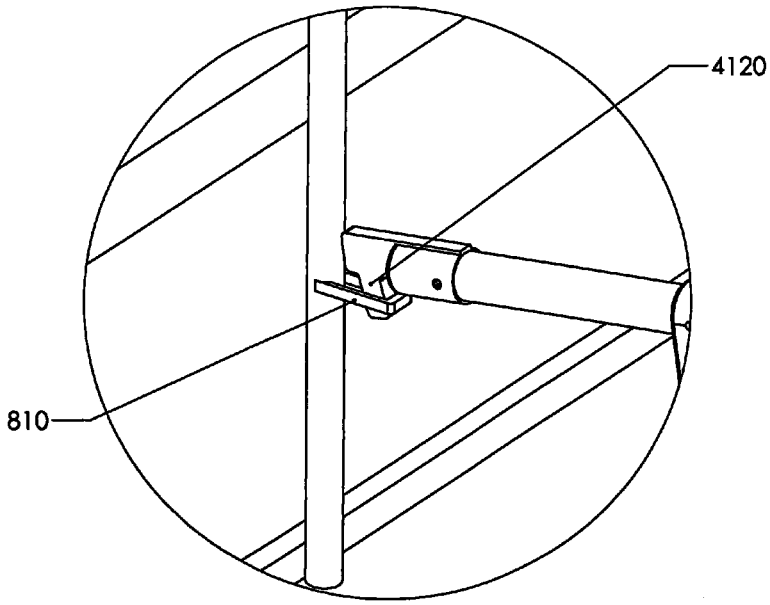
Figure 17b

MOBILITY DEVICE

PRIORITY

This application claims priority to and the prior filing date of provisional application No. 62/100,035 filed on Jan. 5, 2015 which is incorporated by reference herein in its entirety. Further, this application claims priority to provisional patent application 62/110,504 filed on Jan. 31, 2015 the entirety of which is hereby incorporated by reference.

BACKGROUND/FIELD

Exit from and entry into vehicles can be extremely difficult for users of walkers, rollators, and wheelchairs. Structures and devices are disclosed herein which provide a helpful handhold for walker, rollator, and wheelchair users to ease the transition from a motor vehicle to their respective mobility device.

SUMMARY

According to certain embodiments of the present disclosure, a mobility device includes an elongated body having a first end and a second end; a joint near the first end of the body configured to attach the body to at least one of; a gurney, a crutch, a walker, a wheelchair, or a rollator; and a coupler near the second end of the body configured to removably attach the body to the striker plate of an automobile doorframe.

According to further embodiments of the present disclosure, a portion of the body is sized and shaped to be used as a grip or handhold by a user when transitioning from the seat of an automobile to the selected walker, wheelchair, or rollator.

According to further embodiments of the present disclosure, the joint is rigid.

According to further embodiments of the present disclosure, the joint defines a pivot about which the mobility device can rotate.

According to further embodiments of the present disclosure, the joint is a clamp which may be engaged upon a portion of the selected walker, wheelchair, or rollator.

According to further embodiments of the present disclosure, the coupler has an engageable catch disposed thereupon which can temporarily lock the coupler to the door striker.

According to further embodiments of the present disclosure, the grip is sized and shaped to be either pull at or pushed upon be a user.

According to further embodiments of the present disclosure, a mobility device is disclosed having a frame providing at least one hand grip at approximately waist level which a user may grasp wherein the grip is braced against the ground by at least one foot in mechanical communication with the ground; an elongated member having a first and second end, wherein the first end is coupled to the frame and the second end is sized and shaped to be removably engaged upon the metal loop of an automobile door striker plate.

According to further embodiments of the present disclosure, the frame is selected from one of a cane, crutch, walker, or rollator.

According to further embodiments of the present disclosure, the coupling of the elongated member to the frame is capable of pivoting.

According to certain embodiments of the present disclosure, a system for aiding physically impaired individuals is described, the system comprising; a coupler rigidly positioned near one of a car seat, a commode seat, a bed, a chair, a couch, a bathtub, a medical examination table, or an office chair; an elongated body having a first end sized and shaped to be removably engageable to the coupler and a second end pivotably attached to a mobility device selected from one of a walker, wheelchair, rollator, crutch, or cane.

BRIEF DESCRIPTION OF THE FIGURES

In the figures, which are not necessarily drawn to scale, like numerals describe substantially similar components throughout the several views. The drawings illustrate generally, by way of example, but not by way of limitation, various embodiments discussed in the claims of the present document.

FIG. 17*a* shows a perspective view of a mobility grip coupled to a complementary bed rail.

FIG. 17*b* shows an enlarged perspective view of a mobility grip coupled to a complementary bed rail.

DETAILED DESCRIPTION OF THE FIGURES

Figure 1:
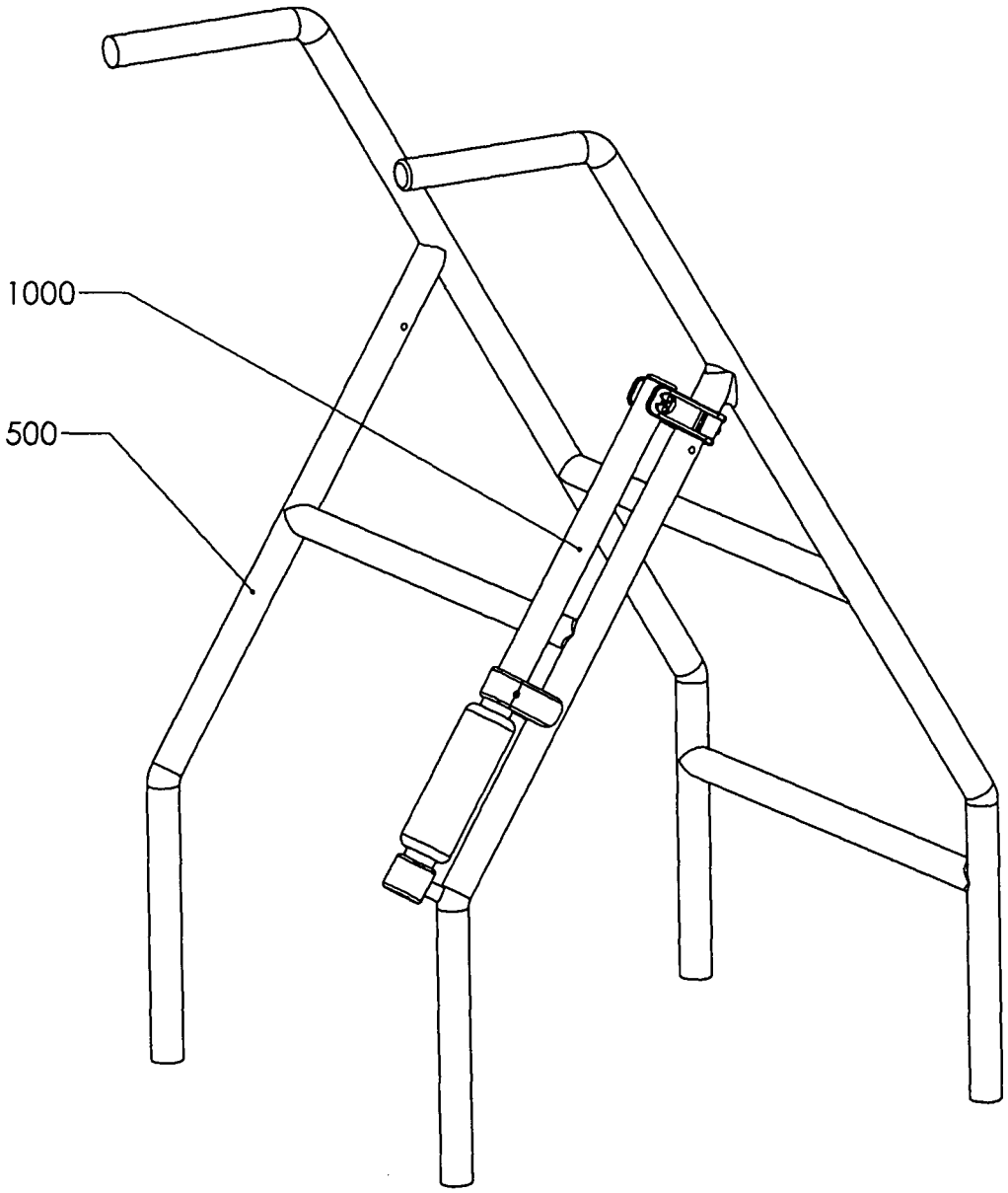
FIG. 1 shows a perspective view of a mobility grip coupled to a walker.

Various embodiments of the presently disclosed apparatus will now be described in detail with reference to the drawings, wherein like reference numerals identify similar or identical elements. In the drawings and in the description that follows, the term "proximal," will refer to the end of a device or system that is closest to the operator, while the term "distal" will refer to the end of the device or system that is farthest from the operator. Similar, anatomical terms of reference such as dorsal, lateral, anterior, and sagittal shall have their accepted meanings in the arts. The terms walker, wheelchair, and rollator shall have their accepted meanings in the arts. An example of a rollator is disclosed by U.S. Pat.

No. 8,434,780 to Li which is incorporated by reference in its entirety. An example of a walker is disclosed by U.S. patent application Ser. No. 14/055,115 by Fang which is incorporated by reference in its entirety. An example of an unpowered wheelchair is disclosed by U.S. Pat. No. 4,326,732 to Gall et. al. and an example of a powered wheelchair is disclosed by U.S. Pat. No. 4,389,056 to Tenniswood, both of which are incorporated by reference in their entirety. When used in the following detailed description, the term "pivotably" shall mean an arrangement where two structures are mechanically coupled and able to rotate relative to one another about an axis.

Referring now to FIG. 1, a mobility grip 1000 is shown coupled to a walker 500.

Figure 2:
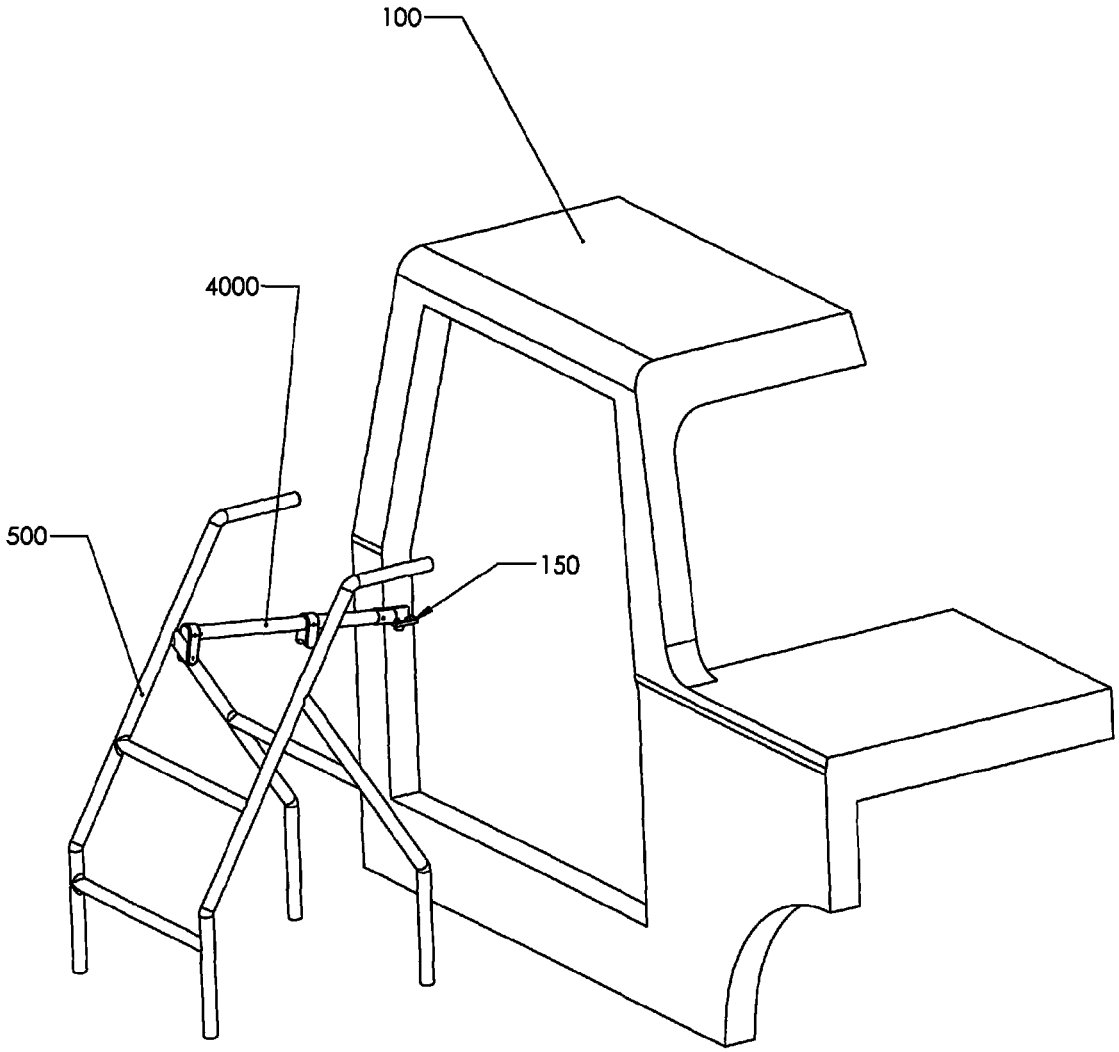
FIG. 2 shows a perspective view of a mobility grip coupled to both a walker and the door striker of an automobile.

Referring now to FIG. 2, a mobility grip 4000 is shown in an exemplary deployed condition wherein the mobility grip 4000 is coupled to both the door striker 150 of an automobile 100 and a walker 500, providing a temporarily rigid connection between the automobile and walker which a user may grasp when exiting the automobile towards the walker.

Figure 3:
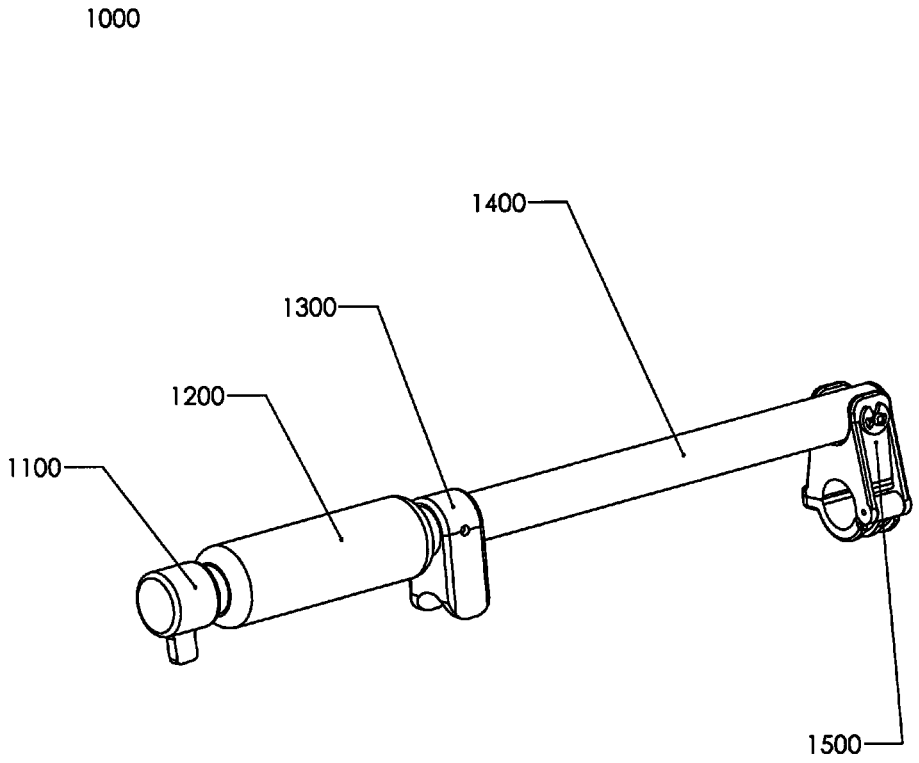
FIG. 3 shows a perspective view of a mobility grip.
Figure 8:
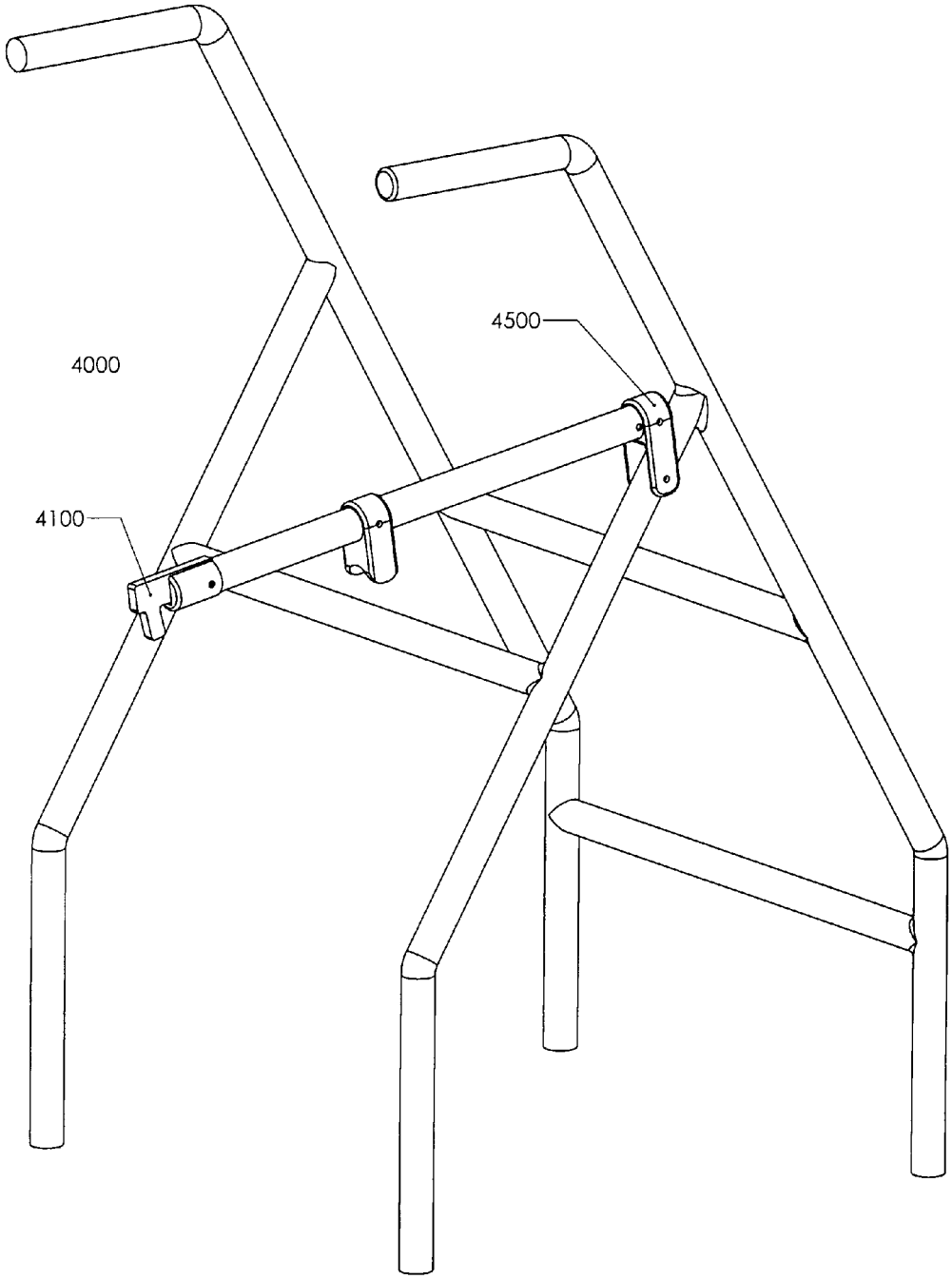
FIG. 8 shows a perspective view of a mobility grip which is coupled to a walker and configured in a "deployed" condition.

Referring now to FIG. 3, a first embodiment of a mobility grip 1000 is shown, wherein the mobility grip includes an elongated tubular body 1400 composed of for instance steel or aluminum welded tubing. There is a front pivot 1500 pivotably coupled to the tubular body 1400 near the cephalic portion of the front pivot by means of a C-pin as shown in the figure via complementary holes which traverse the body of the front pivot and the tubular body 1400. The front pivot is sized and shaped to be rigidly coupled to a portion of a walker, wheelchair, or rollator near the caudal end portion of the front pivot at least as shown in FIGS. 1, 2, and 8.

Figure 18:
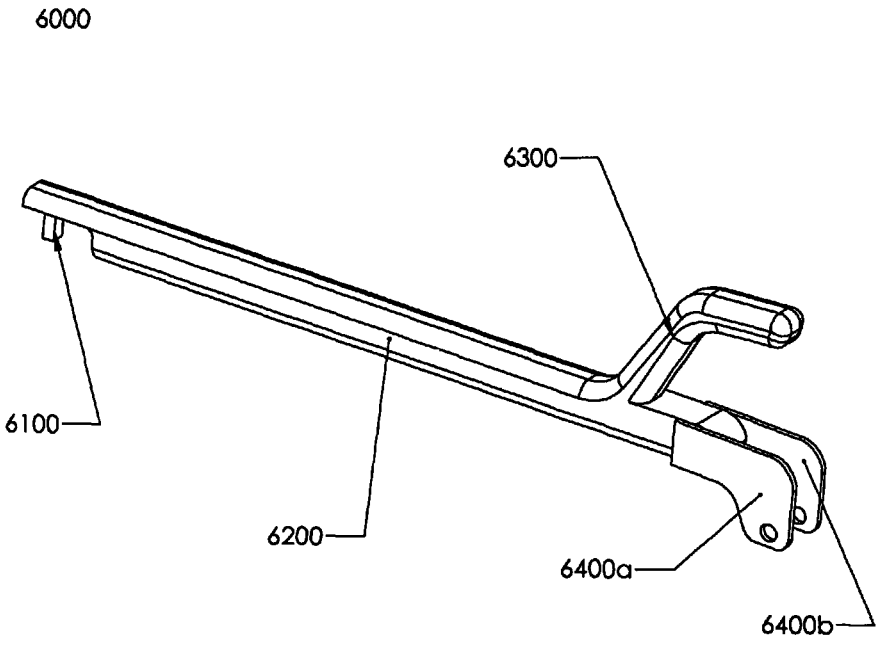
FIG. 18 shows a perspective view of a further embodiment of a mobility grip.

Although tubular body is shown here as a piece of tubing with distinct components disposed thereupon, its function and structure within the meaning of the appended claims may similarly be achieved by an integral polymer or metal structure which incorporated some or all of the features of the "components" into an integral part as shown for instance in FIG. 18.

There is a bar spacer 1300 is disposed upon tubular body 1400 away from front pivot 1500. Bar spacer 1300 is sized and shaped to define the limit of the mobility grip's motion when configured in a "retracted" state and substantially parallel to at least part of the walker, wheelchair, or rollator to which the mobility grip is coupled as shown in FIG. 1. Although bar spacer 1300 is shown oriented near the proximal end portion of tubular body 1400, it can be oriented at any point along the length of tubular body 1400 where it will define the end of the travel.

Although the figures shown a bar spacer 1300 which is fixed to the Mobility grip and moves relative to the walker, wheelchair, or rollator, there are further embodiments of the present disclosure, wherein the bar spacer or a substantially analogous structure is coupled to the walker or rollator and does not move with the mobility grip while still providing a rest for the mobility grip and defining the distance between the mobility grip and the tubing of the walker, wheelchair, or rollator.

There is a handle 1200 disposed upon the proximal-end portion of tubular body 1400. Handle 1200 is sized and shaped to be grasped by the hand of a user. It may be composed of a compressible material including for instance a grippy vinyl or open cell foam or a substantially incompressible material including for instance a textured silicone or santoprene. Although handle 1200 is shown as being disposed solely upon the proximal-end portion of the tubular body 1400, there are further embodiments of the present disclosure wherein it is disposed near the medial or distal-end portion of the tubular body 1400.

There is an end hook 1100 disposed near the proximal end portion of tubular body 1400. End hook 1100 has a feature disposed thereupon which is sized and shaped to removably engage upon the metal loop of a door striker of an automobile.

Figure 4:
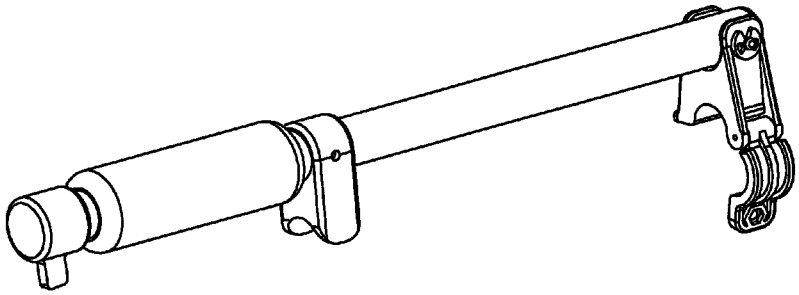
FIG. 4 shows a perspective view of a mobility grip in an open condition.

Referring now to FIG. 4, a mobility grip 1000 is shown in an open condition ready to be engaged upon the tubing of a walker, rollator, or wheelchair.

Figure 5:
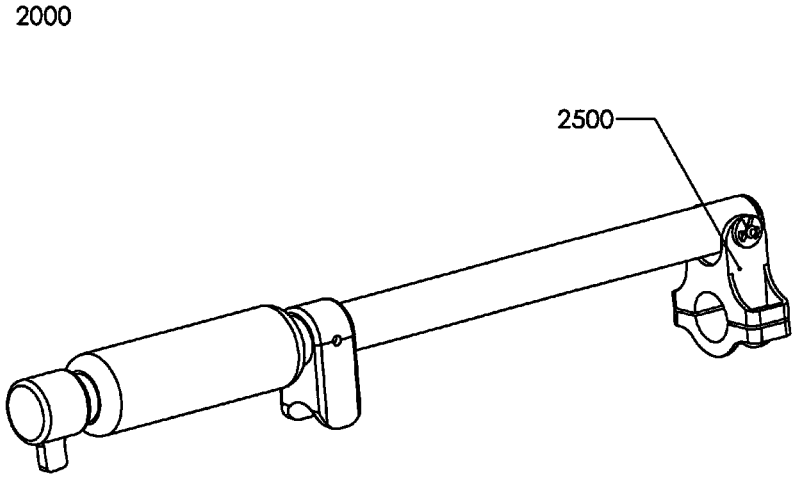
FIG. 5 shows a perspective view of a further embodiment of a mobility grip.

Referring now to FIG. 5, a further embodiment of a mobility grip 2000 is shown wherein the front pivot 2500 has a second, removable "clamp" component which can be used to fix the mobility grip 2000 to the tubing of a walker, wheelchair, or rollator.

Figure 6:
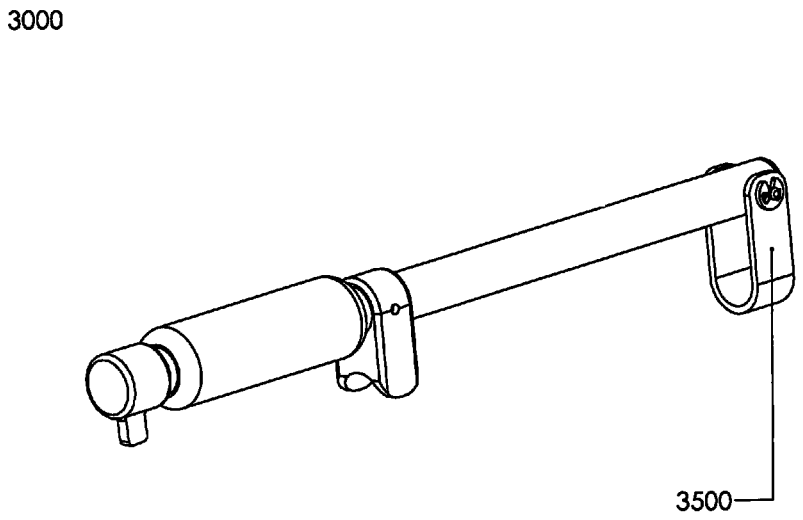
FIG. 6 shows a perspective view of a further embodiment of a mobility grip.

Referring now to FIG. 6, a mobility grip 3000 is shown, wherein there is a front pivot 3500 sized and shaped to be welded, brazed, or bolted directly onto the tubing of a walker, wheelchair, or rollator. In the embodiment of the present disclosure shown in FIG. 6, front pivot 3500 is composed of a metal which can successfully be permanently adhered to the walker, wheelchair, or rollator. Much in the same way that bar spacer 1300 can be inverted while maintaining its function, front pivot 3500 can also be inverted. In such an inverted arrangement, the arch of front pivot 3500 would be coupled to the elongated tube of the mobility grip, while the apertures and pivot pin would extend through a portion of the walker, wheelchair, or rollator.

Figure 7:
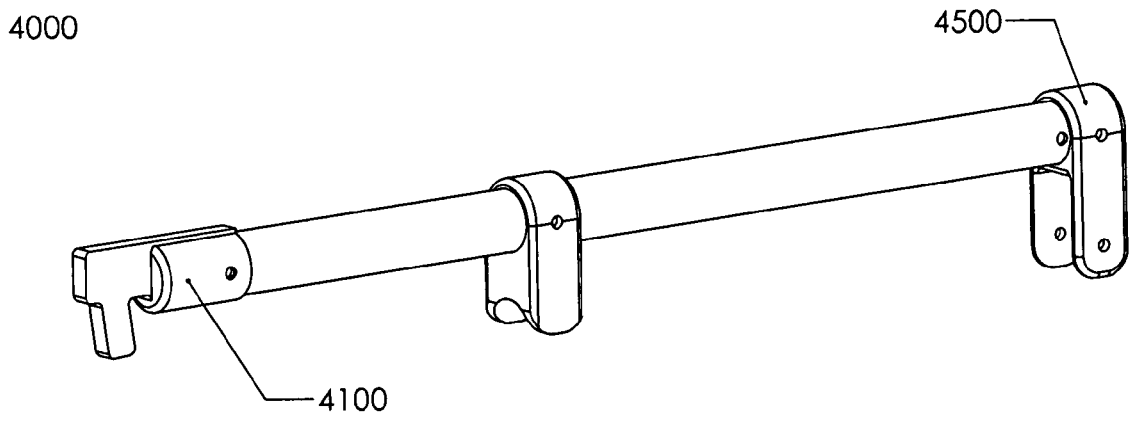
FIG. 7 shows a perspective view of a further embodiment of a mobility grip.

Referring now to FIG. 7, a mobility grip 4000 is shown, wherein a front pivot 4500 is sized and shaped to be rigidly coupled to the mobility grip 4000 at a first end of front pivot 4500 while being pivotably coupled the tubing of a walker, wheelchair, or rollator.

Referring now to FIG. 8, a mobility grip 4000 is shown in a deployed condition wherein front pivot 4500 is fixed relative to mobility grip 4000 but pivots relative to the tube of a walker, wheelchair, or rollator.

Figure 9:
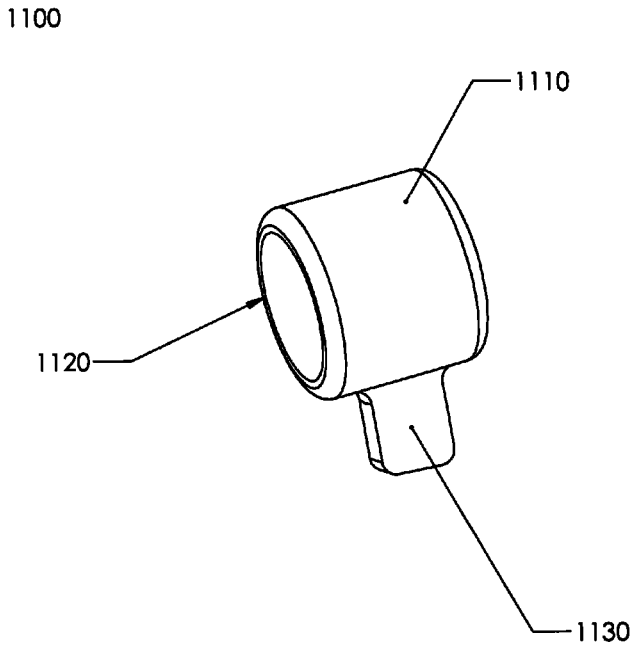
FIG. 9 shows a perspective view of an end hook.

Referring now to FIG. 9, an end hook 1100 is shown, wherein end hook 1100 has a tubular body 1110 with an aperture 1120 extending there-through sized and shaped to be fixed upon tubular body 1400 by means of a mechanical fitting or adhesive.

Figure 10:
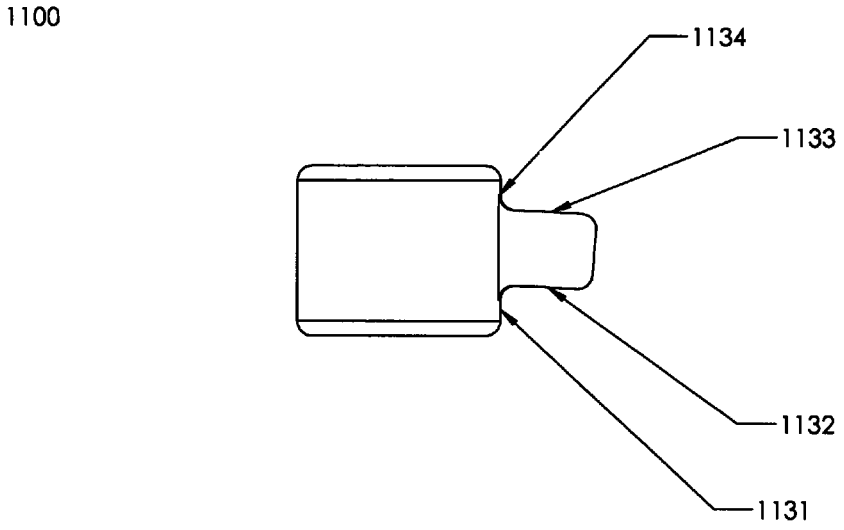
FIG. 10 shows a side view of the end hook of FIG. 9.

Referring now to FIGS. 9 and 10 together, there is a substantially planar tooth 1130 extending from body 1110 sized and shaped to slide into the opening of the metal loop of a an automotive door striker. In the embodiment shown in the figures, the shape of faces 1133 and 1132 of tooth 1130 are arcuate with a center-point at the axis of rotation of the mobility grip. Faces 1134 and 1131 are sized and shaped to rest upon the caudal face of an automobile striker metal loop thereby applying the force of a user leaning upon mobility grip 1000 to the striker.

There are further embodiments of the present disclosure, wherein the shape and function of tooth 1130 is similar to the striker engagement features disclosed by FIG. 2, FIG. 8, FIG. 9, FIG. 9*a*, FIG. 10, and the text of U.S. Pat. No. 6,340,189 granted on Jan. 22, 2002 to William Pordy which is hereby incorporated by reference in its entirety.

Figure 11:
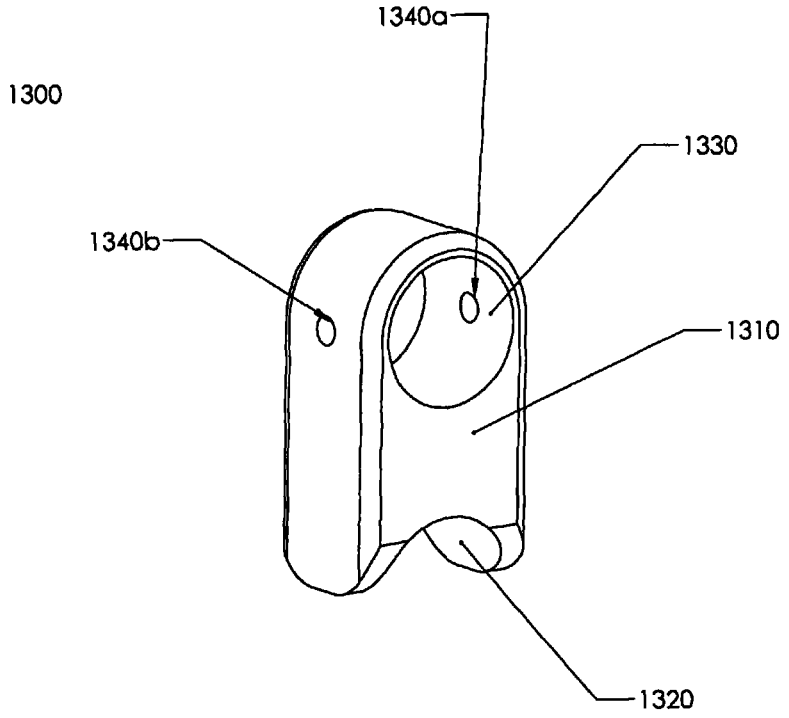
FIG. 11 shows a perspective view of a bar spacer.

Referring now to FIG. 11, a bar spacer 1300 is shown. Bar spacer is a substantially rigid body 1310 composed of a plastic, silicone, or metal having a cephalic aperture 1330 extending there-through sized and shaped to accommodate tubular body 1400 and a caudal arc 1320 cut into the caudal face thereof sized and shaped to rest upon the tubing of the walker, wheelchair, or rollator to which mobility grip 1000 is coupled. Cephalic aperture 1330 is traversed by apertures

1340(*a* and *b*) such that bar spacer 1300 may be coupled to tubular body 1400 by a pin, rivet, or screw.

Figure 12:
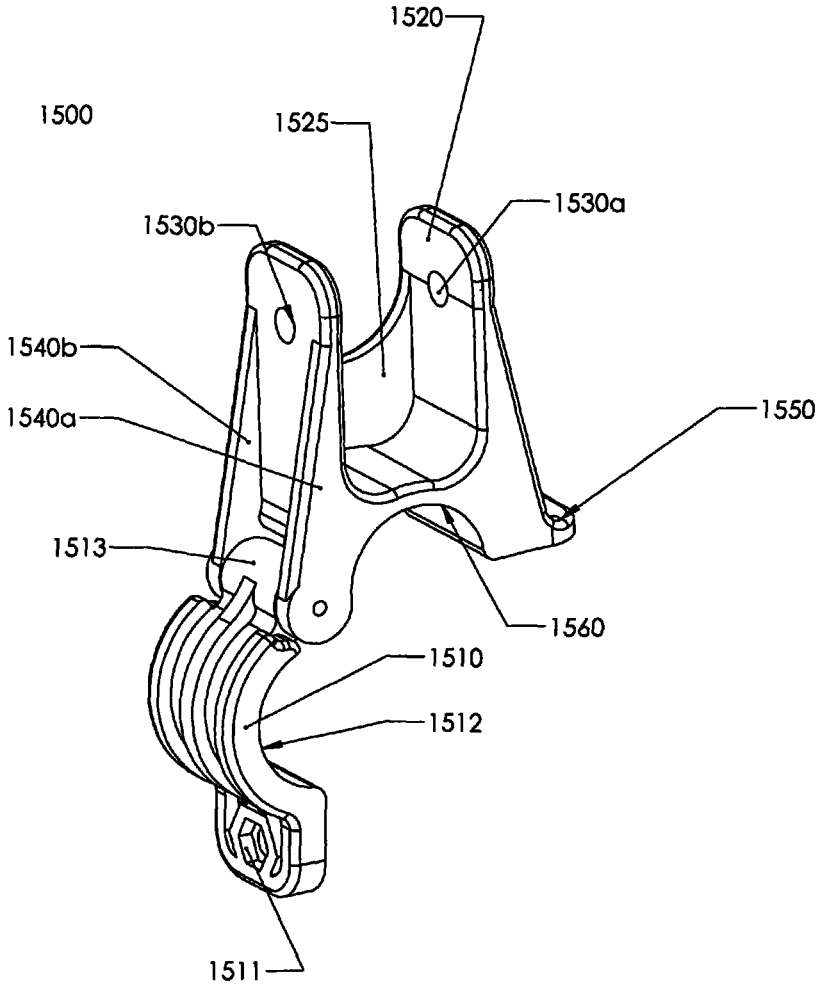
FIG. 12 shows a perspective view of a front pivot configured in a "open" condition.

Referring now to FIG. 12, a front pivot 1500 is shown. Front pivot 1500 is comprises an upper body 1520 with a lower frame 1510 movably coupled thereto about a pivot axis 1513. Upper body 1520 has opposing vertical faces with a reinforcing bridge 1525 there-between. There are complementary apertures 1530(*a* and *b*) disposed upon the opposing faces of upper body 1520 sized, shaped, and oriented so that a pivot pin may pass there-through and provide rotational movement of the front pivot relative to the remainder of mobility grip 1000. There are reinforcement ridges 1540(*a* and *b*) disposed on opposing sides of upper body 1520. The respective caudal portions of ridges 1540(*a* and *b*) have apertures extending there-through for the pin that defines pivot axis 1513.

On the side of top body 1520 opposite ridges 1540(*a* and *b*), there is a substantially platform 1550 having an aperture extending there-through for insertion of a threaded screw which may be used to draw lower frame 1510 towards upper body 1520.

There is a nut retainer 1511 disposed within lower frame 1510 sized and shaped to hold a threaded nut complementary to the screw which may be inserted into platform 1550. There are profile arches 1560 and 1512 which are sized and shaped such that when the lower frame 1510 is urged towards upper body 1520, a profile is defined between arches 1560 and 1512 that can firmly grasp a portion of tubing of a walker, wheelchair, or rollator. According to certain embodiments of the present disclosure, there is a portion of gripping material, including for instance anti-skid foam tape or silicone which has an increased coefficient of friction disposed upon the faces of arches 1560 and 1512 so that they may better engage the walker, rollator, or wheelchair.

Figure 13:
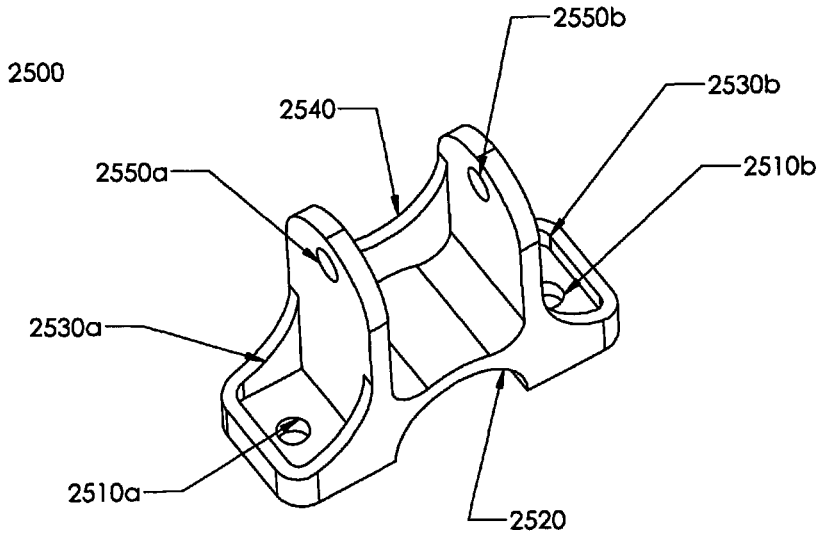
FIG. 13 shows a perspective view of a further embodiment of a front pivot.
Figure 14:
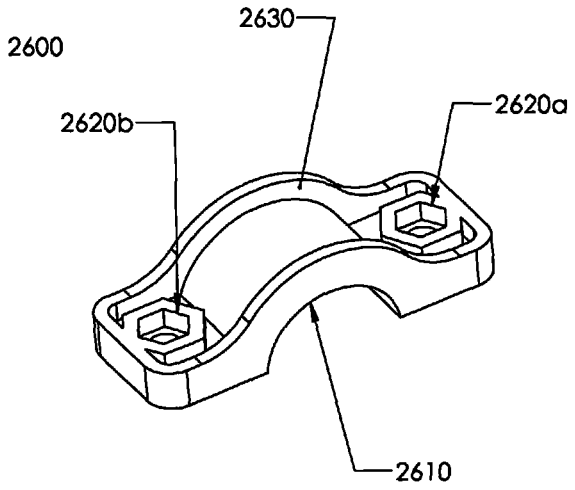
FIG. 14 shows a perspective view of a coupling plate for use with the front pivot of FIG. 13.

Referring now to FIGS. 13 and 14 together, a front pivot 2500 and complimentary coupling plate 2600 are shown. Front pivot 2500 has a plurality of structures which are similar in function to those of front pivot 1500 with the exception that here coupling plate 2600 in mobility grip 2000 substantially replaces the function of lower frame 1510 of mobility grip 1000.

There are two apertures 1510(*a* and *b*) sized and shaped for threaded screws to extend there-through into coupling plate 2600 where they can be engaged upon by nuts disposed in nut retainers 2620(*a* and *b*). When the screws are tightened, the distance between arch 2610 and arch 2520 is decreased and engaged upon a portion of tubing of a walker, wheelchair, or rollator. There is a reinforcement ridge 2630 disposed about the edge of coupling plate 2600.

Figure 15:
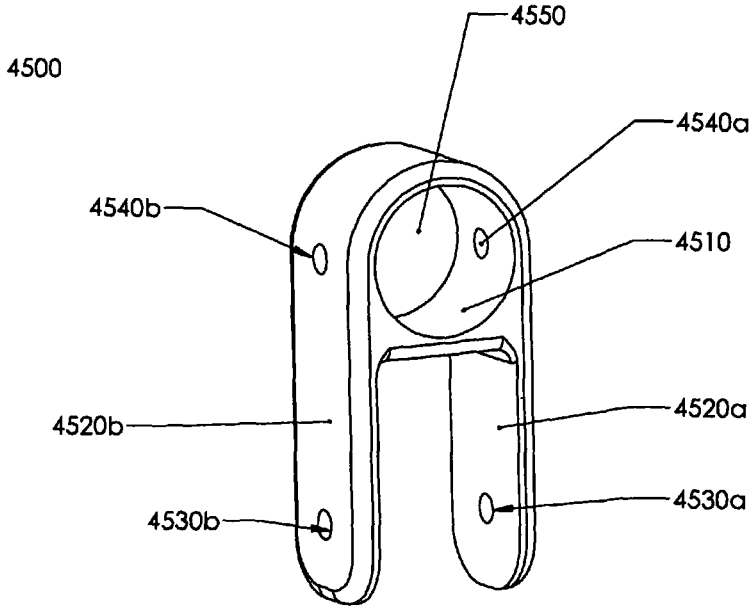
FIG. 15 shows a perspective view of a further embodiment of a front pivot.
Figure 16:
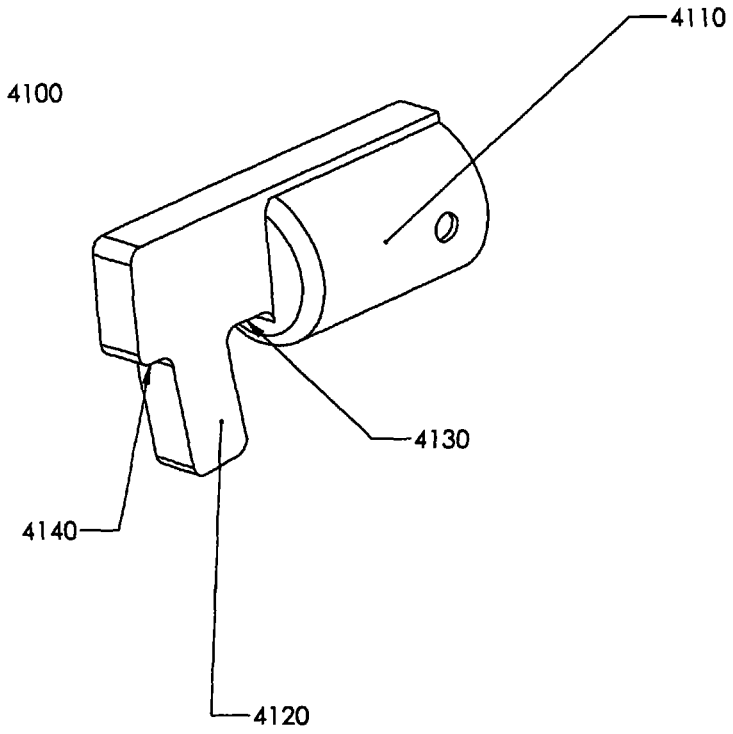
FIG. 16 shows a perspective view of a further embodiment of an end hook.

Referring now to FIG. 15, a front pivot 4500 of a mobility grip 4000 is shown. The elongated tube portion of mobility grip 4000 is coupled to aperture 4510 using a bolt or rivet through holes 4540(*a* and *b*). Aperture 4510 terminates at back wall 4550 which defines the depth of the aperture. There are two arms 4520(*a* and *b*) which extend caudally from the body of front pivot 4510 and have to apertures 4530(*a* and *b*) disposed near the caudal end portion thereof. Apertures 4530(*a* and *b*) are sized and shaped to accommodate a pivot pin which extends through them as well as a complementary aperture in the tubing from which a wheelchair, walker, or rollator to which the device is attached is constructed.

Front pivot 4500 is designed to rotate with the remainder of the mobility grip 4000 about the axis defined by apertures 4530(*a* and *b*). The limit of this rotation is defined by the underside of the portion of material below aperture 4510 which abuts the tubing of the wheelchair, rollator, or walker at said limit.

An end hook 4100 is shown, wherein end hook 4100 includes a tubular body 4110 sized and shaped for attachment to the proximal end portion of a mobility grip 4000. There are apertures extending though body 4110 sized and shaped to accommodate a bolt or rivet for securing said attachment. At the proximal-end portion of end hook 4100, there is a rigid hook 4120 sized and shaped to be engaged upon a automobile door striker and striker plate. When so engaged, tooth 4120 extends into the central hole of the striker loop while faces 4130 and 4140 rest upon the rings of the striker plate loop.

Referring now to FIG. 18, a further embodiment of the mobility grip 6000 is shown. Mobility grip 6000 is molded from an integral portion of polymer and has a striker engagement tooth 6100 at the proximal-end portion thereof. There is an elongated body 6200 along which the features of mobility grip 6000 are situated. Mobility grip 6000 also has a raised grasping portion 6300 disposed along body 6200. Grip 6300 is sized and shaped so that a user can grasp and pull the handle towards themselves, thereby urging their own bodies up and forward out of a seated position. There are two pivot plates 6400(*a* and *b*) disposed near the distal-end portion of body 6200 having apertures extending there-through which are sized and shaped to accommodate a pivot pin which extends into the body of a walker, rollator, or wheelchair and therefor define the axis of mobility grip 6000's rotation relative to the walker, rollator, or wheelchair.

The end hooks 4100 and 1100 may be comprised of an integral portion of polymer such as nylon, reinforced polymer such as glass-filled nylon, entirely of metal such as cast aluminum, or a composite where the tooth portions are metal which has been joined to a polymer body by a mechanical or chemical coupling means known in the manufacturing arts.

In a further embodiment of the present disclosure, a mobility grip is used with a complimentary coupler disposed upon "other structures" including for instance furniture or durable medical equipment. The coupler is functionally similar to an automobile striker wherein the coupler is sized and shaped for end hook 1100 or a related structure on a mobility grip to engage upon. An example of such a coupler and arrangement is shown in FIGS. 17*a* and 17*b* where the exemplary "other structure" is a bed grab bar.

Referring now to FIGS. 17*a* and 17*b* together, a bed grab bar Boo is shown engaged to a bed and box spring. Bed grab bar Boo has a complementary coupler 810 disposed thereupon sized and shaped to be engaged upon by tooth 4120 of a mobility grip 4000. In such an arrangement, the body of the mobility grip provides a handhold upon which a user can brace themselves when moving from a seated position at the edge of the bed to an ambulating position with their hands engaged upon the grips of the walker. When the user is at the walker, he can lift the mobility grip relative to the walker pivoting the mobility grip about the front pivot and thereby disengaging the tooth 4120 from coupler 810.

The "other structures" contemplated by the present disclosure which can be modified in the manner described by the preceding paragraph include furniture and durable medical equipment to which a complementary coupler for engagement with the mobility grip 1000 can be attached to provide a handhold for a user. These other structures include bed rails including for instance U.S. Pat. No. 7,032,265 to Miller which is incorporated by reference in its entirety, recliners including for instance U.S. Pat. No. 5,895,093 to Casey et. al. which is incorporated by reference herein in its entirety, commode seats including for instance U.S. Pat. No. 6,857,138 to Moser et. al. which is incorporated by reference in its entirety, dining chairs including for instance U.S. Pat. D253924 which is incorporated by reference in its entirety, couch handles including for instance U.S. Pat. No. 7,234,182 to Miller et. al. which is incorporated by reference in its entirety, as well as other articles of furniture or medical equipment known in the arts which a user may occupy in a seated position from which they may desire to arise.

An exemplary method of using a mobility grip will now be described. Initially, the mobility grip is provided in a first disengaged condition as shown in FIG. 4. The user then positions the mobility grip such that arch 1560 abuts the tubing of a walker. Door 1510 is drawn closed to grasp the tubing of the walker and a screw and nut are inserted through stage 1550 and nut holder 1511 respectively. They are tightened relative to one another, thereby engaging arches 1512 and 1560 about the tubing of the walker and fixing the mobility grip thereto. The mobility grip 1000 is then allow to drop naturally with gravity about the pivot pin in pivot 1500 until arch 1320 rests upon the tubing of the walker as shown in FIG. 1.

Next, the walker is positioned outside of an opened automobile door with the tooth of the end cap engaged within the metal loop a door striker and the feet of the walker 500 resting upon the ground. Here, the elongated body of the mobility grip (in this instance 4000) provides a handhold upon which the user can brace themselves to aide in egress from the vehicle. The tooth can be disengaged from the door striker plate by either lift the tooth upwards using the front pivot or by lifting upon the entire walker and mobility grip assembly. Once disengaged from the striker plate loop, the mobility grip can fall back to the configuration shown in FIG. 1.

Although the mobility device of the present disclosure has been described with reference to specific structures, these are intended sole as exemplary ways of implementing the claims which are appended below. Within the scope of the present disclosure, the word "removably" shall be understood to mean "a relationship where at least two structures possess complementary features which may be temporarily mechanically joined to one another."

What is claimed is:

1. A mobility device comprising, a. an elongated body having a first end and a second end and a long axis extending therethrough, b. a movable joint near the first end of the body configured to attach the body to at least one of a gurney, or a crutch, or a walker, or a wheelchair, or a cane, or a rollator;

c. and a coupler near the second end of the body wherein the coupler is an elongated ping extending a generally normal direction from the long axis of the body wherein a portion of the coupler's outer cross-section is sized and shaped to firmly and removably be inserted into and attach to the interior cross section of the metal loop of the striker plate of an automobile doorframe;

d. wherein a portion of the body between the coupler and the joint is sized and shaped to be used as a handhold by a user when transitioning from the seat of an automobile to the selected walker, gurney, crutch, cane, wheelchair, or rollator thereby defining a grip;

e. wherein the movement of the body about the joint defines two configurations of the device, a first, "deployed" configuration wherein the coupler extends generally downward toward the ground through the loop of an automobile striker plate and the grip extends generally horizontally from the striker plate to the selected walker, gurney, crutch, cane, wheelchair, or rollator providing a firm support against the striker plate which a user may brace themselves when transitioning into and out of an automobile and a second "retracted" configuration wherein the body rests in a substantially parallel configuration to an immediately adjacent portion of the gurney, crutch, walker, wheelchair, cane, or rollator with a mechanical "stop" disposed upon the body between the joint and coupler which rests upon the gurney, crutch, walker, wheelchair, cane or rollator defining a gap between the body and the crutch, walker, wheelchair, cane, or rollator in a manner so as prevent swaying of the body upon movement of the assembly, and orient the arm so as not to substantially protrude from or interfere with the non-automobile use of the resultant assembly.

2. The mobility device of claim 1, wherein a portion of the body is sized and shaped to be used as a grip or handhold by a user when transitioning from the seat of an automobile to the selected walker, wheelchair, or rollator.

3. The mobility device of claim 1, wherein the joint is rigid.

4. The mobility device of claim 1, wherein the joint defines a pivot about which the mobility device can rotate.

5. The mobility device of claim 1, wherein the joint is a clamp which may be engaged upon a portion of the selected cane, gurney, crutch, walker, wheelchair, or rollator.

6. The mobility device of claim 1, wherein the coupler has an engageable catch disposed thereupon which can temporarily lock the coupler to the door striker.

7. The mobility device of claim 1, wherein the grip is sized and shaped to be either pulled at or pushed upon by a user.

8. A kit for temporarily coupling a piece of furniture with a mobility aide and assisting in patient transfer therebetween, the kit comprising; a coupler comprising a generally horizontal and rigid loop having a generally downward facing aperture with the coupler being rigidly positioned near one of a commode seat, a bed, a chair, a couch, a bathtub, a medical examination table, or an office chair; b. an elongated body having a long axis extending therethrough and a first end of the body having a pin extending outward therefrom, with the pin being sized and shaped to be firmly and removably insertable into and engageable upon the coupler and a second end movably attached by a joint to a mobility aide selected from one of a walker, wheelchair, rollator, gurney, crutch, or cane wherein there is sufficient space between the first and second end of the body for them to be comfortably grasped by the hand of a user, the elongated body is configurable by means of the joint into a first configuration in which it couples the furniture to the mobility aide to provide a handhold upon which a user may brace themselves and a second configuration in which the body is retracted into a substantially flush configuration with the profile of the mobility aide, and the pin is sized and shaped to be insertable into the coupler by a translation of the body along the travel of the joint.

* * * * *